US010619889B2

(12) United States Patent
Takeuchi et al.

(10) Patent No.: US 10,619,889 B2
(45) Date of Patent: Apr. 14, 2020

(54) WATER HEATER

(71) Applicant: PALOMA CO., LTD, Aichi (JP)

(72) Inventors: Makoto Takeuchi, Aichi (JP); Wataru Nakanishi, Aichi (JP)

(73) Assignee: PALOMA CO., LTD., Aichi (JP)

( * ) Notice: Subject to any disclaimer, the term of this patent is extended or adjusted under 35 U.S.C. 154(b) by 123 days.

(21) Appl. No.: 15/942,727

(22) Filed: Apr. 2, 2018

(65) Prior Publication Data

US 2018/0340710 A1 Nov. 29, 2018

(30) Foreign Application Priority Data

May 25, 2017 (JP) ..... 2017-103868

(51) Int. Cl.

| | |
|---|---|
| ***F24H 9/20*** | (2006.01) |
| ***F24H 9/18*** | (2006.01) |
| ***F24H 1/14*** | (2006.01) |
| ***F24H 1/46*** | (2006.01) |
| ***F23N 5/02*** | (2006.01) |
| ***F24D 19/10*** | (2006.01) |
| ***F24H 1/52*** | (2006.01) |

(52) U.S. Cl.

CPC ..... *F24H 9/2035* (2013.01); *F23N 5/02* (2013.01); *F24D 19/1051* (2013.01); *F24H 1/145* (2013.01); *F24H 1/46* (2013.01); *F24H 1/523* (2013.01); *F24H 9/1836* (2013.01); *F23N 2225/19* (2020.01); *F23N 2241/04* (2020.01)

(58) Field of Classification Search

CPC ..... F24H 9/20; F24H 9/2007; F22D 7/00

See application file for complete search history.

(56) References Cited

U.S. PATENT DOCUMENTS 4,501,261 A * 2/1985 Tsutsui ..... F23N 1/082 122/14.3
4,819,587 A * 4/1989 Tsutsui ..... F23N 1/082 122/14.2
5,058,804 A * 10/1991 Yonekubo ..... E03C 1/04 236/12.12

(Continued)

FOREIGN PATENT DOCUMENTS

JP 2008-57845 A 3/2008
JP 2010-117053 A 5/2010

*Primary Examiner* — Gregory A Wilson

(74) *Attorney, Agent, or Firm* — Maier & Maier, PLLC

(57) ABSTRACT

A water heater includes a plurality of stages of burners, a water supply pipe, a hot water outlet pipe, a heat exchanger, a passing water quantity control unit, a temperature detection unit, and an operation control unit. The operation control unit, upon confirmation that a predetermined start condition of a passing water restriction is satisfied at a start of a hot water supply, performs the output hot water temperature control by calculating a target flow rate that causes no switching or a minimum count of switching of the combustion stages of the burners and configuring the passing water quantity control unit to have the target flow rate. The operation control unit, upon confirmation that a predetermined release condition of the passing water restriction is satisfied, executes the passing water control in which the passing water quantity is returned to the predetermined water quantity by gradually releasing the passing water restriction.

4 Claims, 5 Drawing Sheets

(56) References Cited

U.S. PATENT DOCUMENTS

| | | | | |
|---|---|---|---|---|
| 6,596,159 | B1 * | 7/2003 | Maruyama | B01J 49/85<br>137/624.11 |
| 7,628,123 | B2 * | 12/2009 | Inami | F24D 12/02<br>122/448.3 |
| 8,733,297 | B2 * | 5/2014 | Tsuji | F23N 1/082<br>122/14.2 |

* cited by examiner

WATER HEATER

PRIORITY

This application claims the benefit of Japanese Patent Application Number 2017-103868 filed on May 25, 2017, the entirety of which is incorporated by reference.

FIELD

The disclosure relates to a water heater including a passing water quantity control means that controls a passing water quantity in a heat exchanger.

BACKGROUND

In a water heater, a water supply pipe and a hot water outlet pipe are coupled to a heat exchanger, which is heated with a burner. When a faucet is opened to pass water through inside an apparatus, a controller (an operation control means) that detects the passing water causes the burner to burn to heat the water that passes through the heat exchanger. Then, hot water is output from the hot water outlet pipe. Among such water heaters, as disclosed in Japanese Unexamined Patent Application Publication No. 2008-57845 (JP-A-2008-57845), there is known a water heater that includes a passing water quantity control means, such as a water servo, that controls a passing water quantity in the heat exchanger in the water supply pipe. The controller performs a combustion control of the burner and an operational control of the passing water quantity control means to perform an output hot water temperature control. The output hot water temperature control causes a detected temperature (output hot water temperature) obtained from a temperature detection means, such as a thermistor, disposed in the hot water outlet pipe to match a set temperature.

However, in the water heater of JP-A-2008-57845, at a start of a hot water supply, the passing water quantity controlled by the passing water quantity control means is set to a predetermined water quantity. Therefore, in the case of what is called a cold start, the output hot water temperature takes time to reach the set temperature and a consumption quantity of water and fuel gas during that period increases, thereby leading to a loss. The cold start is when a temperature of inflow water is low when a power supply is first turned on to start an operation after the water heater is installed or when the operation is started after a lapse of long time since the last hot water supply.

Therefore, the applicant has provided the following disclosure in Japanese Unexamined Patent Application Publication No. 2010-117053 (JP-A-2010-117053). The operation control means compares the detected temperature obtained from the temperature detection means with the set temperature at the start of the hot water supply. When the detected temperature is lower than the set temperature by a predetermined amount, the output hot water temperature control is executed by configuring the passing water quantity control means to have a passing water quantity that is further restricted compared with the predetermined water quantity. Thus, the reach time to the set temperature is reduced even in the case of the cold start, thereby ensuring conserved water and gas.

In the passing water control in JP-A-2010-117053, after the output hot water temperature matches the set temperature, the restriction of the passing water quantity needs to be gradually released to return the passing water quantity back to the predetermined water quantity. However, there is a case where the burner is constituted of a plurality of stages of units (burner group) that are divided into each of a plurality of burners, each of which includes mutually different numbers of burners, and performs a switching control of combustion stages by selecting the unit to burn. In such case, for switching of the combustion stages, a control is performed such that a gas input is once decreased to transfer a fire to a neighboring unit and then the gas input is increased in order to smoothly transfer the fire. Therefore, in spite of performing a control to increase the output hot water temperature at the start of the hot water supply, the control to decrease the gas input is temporarily performed due to switching of the combustion stages. As a result, the output hot water temperature does not linearly increase proportionately to an increase of the passing water quantity, and an undershoot possibly occurs, which fluctuates reacting to the increase and decrease of the gas input.

The following describes what is mentioned above specifically. First, FIG. 4 is a graph showing a restriction control of the passing water quantity at the start of the hot water supply and change of the output hot water temperature. A dotted line indicates the passing water quantity and a solid line indicates the output hot water temperature. The restriction control here is the following control. When an ignition is started at t1, the passing water quantity is restricted from the predetermined water quantity until t2. After the restricted passing water quantity is maintained until t3, the restriction is gradually released to return the passing water quantity back to the predetermined water quantity at t4. Accordingly, it is ideal that, with this restriction control, the output hot water temperature linearly increases and stabilizes at the set temperature as indicated by a two-dot chain line.

Meanwhile, FIGS. 5A and 5B illustrate a switching control in the case where there are three stages (three units) of burners. As illustrated in FIG. 5A, at the start of the hot water supply (t1), a burner in the second stage is used at an intermediate input. In association with the restriction of the passing water quantity, after the gas input is restricted to a lower limit input as indicated by a solid line arrow, the gas input is switched to a lower limit input of the first stage as indicated by a dotted arrow. After the gas input is increased from that point to cause a fire to transfer, further in association with the restriction of the passing water quantity, the input is restricted as indicated by the solid line arrow. In the example of FIGS. 5A and 5B, the input is maintained at points indicated by black points in the solid line arrow when the passing water quantity is at the lower limit (between t2 and t3).

Then, as illustrated in FIG. 5B, when the restriction of the passing water quantity is released from t3, after the gas input is increased to an upper limit input of the first stage as indicated by the solid line arrow, the gas input is restricted to the intermediate input as indicated by the dotted arrow. The fire is transferred in a state where the gas input is slightly restricted from the intermediate input of the second stage. Next, as indicated by the solid line arrow, after the gas input is increased to the upper limit input of the second stage, the gas input is restricted to the intermediate input as indicated by the dotted arrow. The fire is transferred in a state where the gas input is slightly restricted from the intermediate input of the third stage and the input is increased until t4 as indicated by the solid line arrow.

Thus, since switching of the combustion stages is performed twice between t3 and t4 in which the restriction of the passing water quantity is released, the output hot water temperature does not linearly increase like the two-dot chain line illustrated in FIG. 4 but to fluctuate in a portion T1. Therefore, the undershoot occurs.

SUMMARY

Therefore, it is an object of the disclosure to provide a water heater that can perform a stable output hot water temperature control without an occurrence of an undershoot when a restriction of a passing water quantity is released in the water heater that performs a control to restrict the passing water quantity at a start of a hot water supply ("undershoot" refers to a phenomenon in which an output hot water temperature is temporarily lowered, not linearly increasing proportionately to an increase of the passing water quantity).

In order to achieve the above-described object, there is provided a water heater according to a first aspect of the disclosure. The water heater includes a plurality of stages of burners, a water supply pipe, a hot water outlet pipe, a heat exchanger, a passing water quantity control unit, a temperature detection unit, and an operation control unit. The heat exchanger is coupled to the water supply pipe and the hot water outlet pipe. The heat exchanger is heated with the burners. The passing water quantity control unit is disposed in the water supply pipe. The passing water quantity control unit controls a passing water quantity in the heat exchanger. The temperature detection unit detects a hot water temperature inside the hot water outlet pipe. The operation control unit executes an output hot water temperature control in which a detected temperature obtained from the temperature detection unit is caused to match a set temperature by a switching control of combustion stages of the burners and an operational control of the passing water quantity control unit. The operation control unit, upon confirmation that a predetermined start condition of a passing water restriction is satisfied at a start of a hot water supply, performs the output hot water temperature control by calculating a target flow rate that is smaller than a predetermined water quantity and causes no switching or a minimum count of switching of the combustion stages of the burners and configuring the passing water quantity control unit to have the target flow rate. The operation control unit, upon confirmation that a predetermined release condition of the passing water restriction is satisfied, executes the passing water control in which the passing water quantity is returned back to the predetermined water quantity by gradually releasing the passing water restriction.

According to a second aspect of the disclosure, in the first aspect of the disclosure, the start condition of the passing water restriction may be that the detected temperature is lower than the set temperature by a predetermined temperature or more by comparing the detected temperature with the set temperature.

According to a third aspect of the disclosure, in the first aspect or the second aspect of the disclosure, the release condition of the passing water restriction may be that a difference between the detected temperature and the set temperature is within a predetermined temperature.

With the disclosure according to the first aspect, the operation control unit, upon confirmation that the predetermined start condition of the passing water restriction is satisfied at the start of the hot water supply, performs the passing water quantity control by calculating the target flow rate that is smaller than the predetermined water quantity and causes no switching or the minimum count of switching of the combustion stages of the burners and configuring the passing water quantity control unit to have the target flow rate. Therefore, the undershoot when the restriction of the passing water quantity is released can be inhibited.

With the disclosure according to the second aspect, in addition to the effect of the first aspect, the start condition of the passing water restriction is that the detected temperature is lower than the set temperature by the predetermined temperature or more. Therefore, even in the case of what is called the cold start, the reach time to the set temperature can be reduced, thereby leading to the conserved water and gas.

On the other hand, in the case of a hot start in which the detected temperature becomes high, the start condition of the passing water restriction is not satisfied. Therefore, the passing water restriction is not executed and prevention of damaging a convenience of a user can be ensured.

With the disclosure according to the third aspect, in addition to the effect of the first aspect or the second aspect, the release condition of the passing water restriction is that the difference between the detected temperature and the set temperature is within the predetermined temperature. Therefore, the passing water quantity can be retuned back to the predetermined water quantity at the appropriate timing.

DETAILED DESCRIPTION

The following describes an embodiment of the disclosure based on the drawings.

Figure 1:
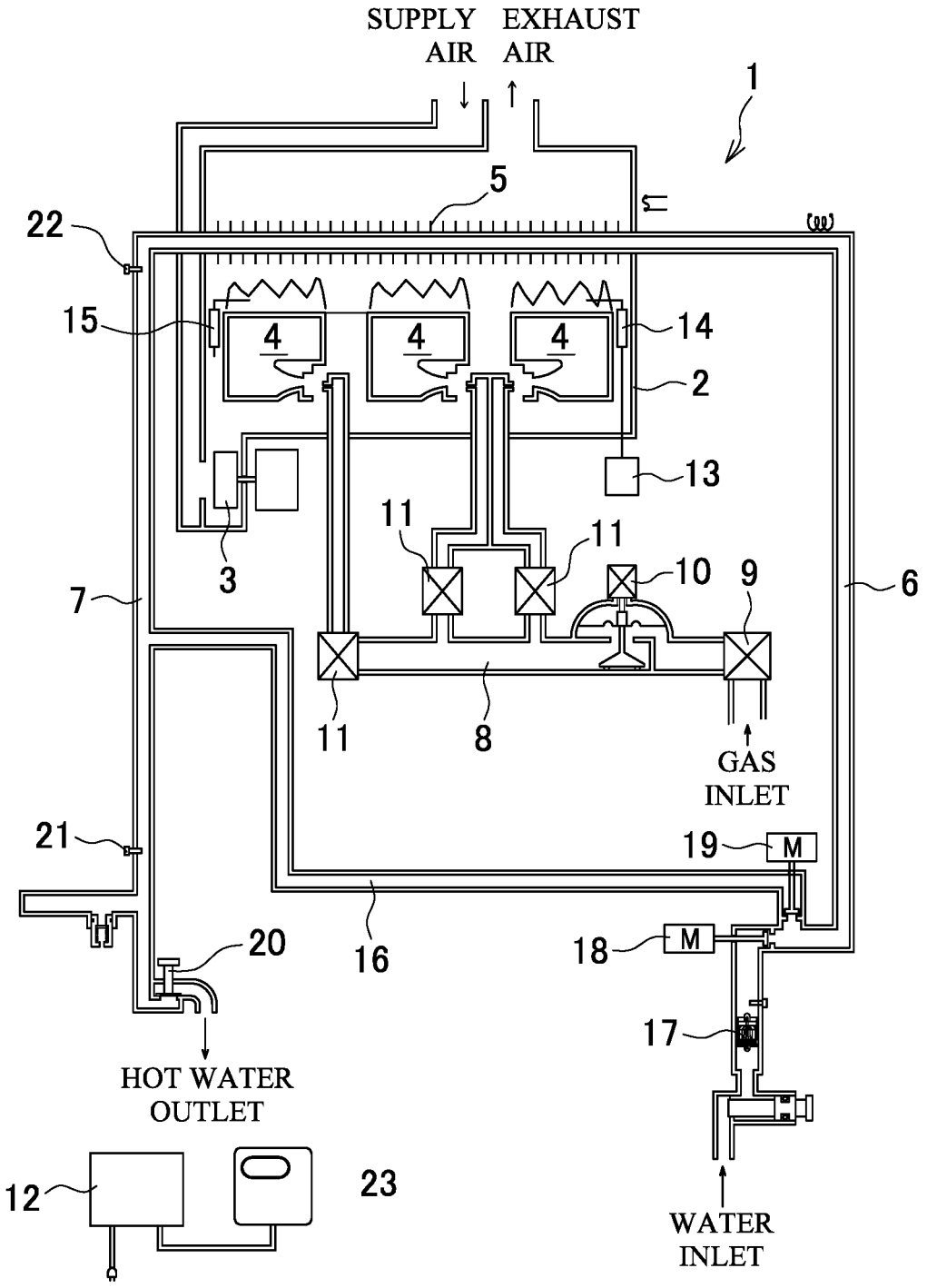
FIG. 1 is a schematic diagram of a water heater.

FIG. 1 is a schematic diagram illustrating an exemplary water heater. A water heater 1 includes a combustion chamber 2 that is formed within an apparatus main body of the water heater 1 and has an air supply fan 3. The combustion chamber 2 internally includes a plurality (here three units with respective different combustion capacities) of burners 4, 4 . . . and a heat exchanger 5. The burners 4 burn mixed gas of fuel gas and primary air from the air supply fan 3. The heat exchanger 5 is heated with a combustion of the burners 4. The heat exchanger 5 is coupled to a water supply pipe 6 and a hot water outlet pipe 7. A main solenoid valve 9 and a gas proportional valve 10 are disposed in a gas pipe 8 to the burners 4. The gas pipe 8 includes branch pipes to the respective burners 4. The branch pipes branch from the gas pipe 8 and include respective switching solenoid valves 11, 11 . . . Each of the valves is controllable with a controller 12 as an operation control means. An ignitor 13, an ignition electrode 14, and a flame rod 15 are used.

Between the water supply pipe 6 and the hot water outlet pipe 7, a bypass pipe 16 that bypasses the heat exchanger 5 is coupled. The water supply pipe 6 has an upstream side with respect to a coupling position with the bypass pipe 16. In the upstream side, a water quantity sensor 17 and a water servo 18 are disposed. The water quantity sensor 17 detects a water quantity flowing in the whole apparatus. The water servo 18 serves as a passing water quantity control means. At the coupling position with the bypass pipe 16, a bypass servo 19 that controls the water quantity to the bypass pipe 16 is disposed. The water quantity sensor 17, the water servo 18, and the bypass servo 19 are each electrically coupled to the controller 12. On the other hand, the hot water outlet pipe 7 is coupled to a hot water tap 20. The hot water outlet pipe 7 includes thermistors 21 and 22 that detect temperatures of hot water in a downstream side and an upstream side (a side of outlet from the heat exchanger 5), respectively, with respect to a coupling position of the bypass pipe 16. The thermistors 21 and 22 are electrically coupled to the controller 12. A remote control 23 is configured to perform a setting operation of, for example, a set temperature.

Figure 2:
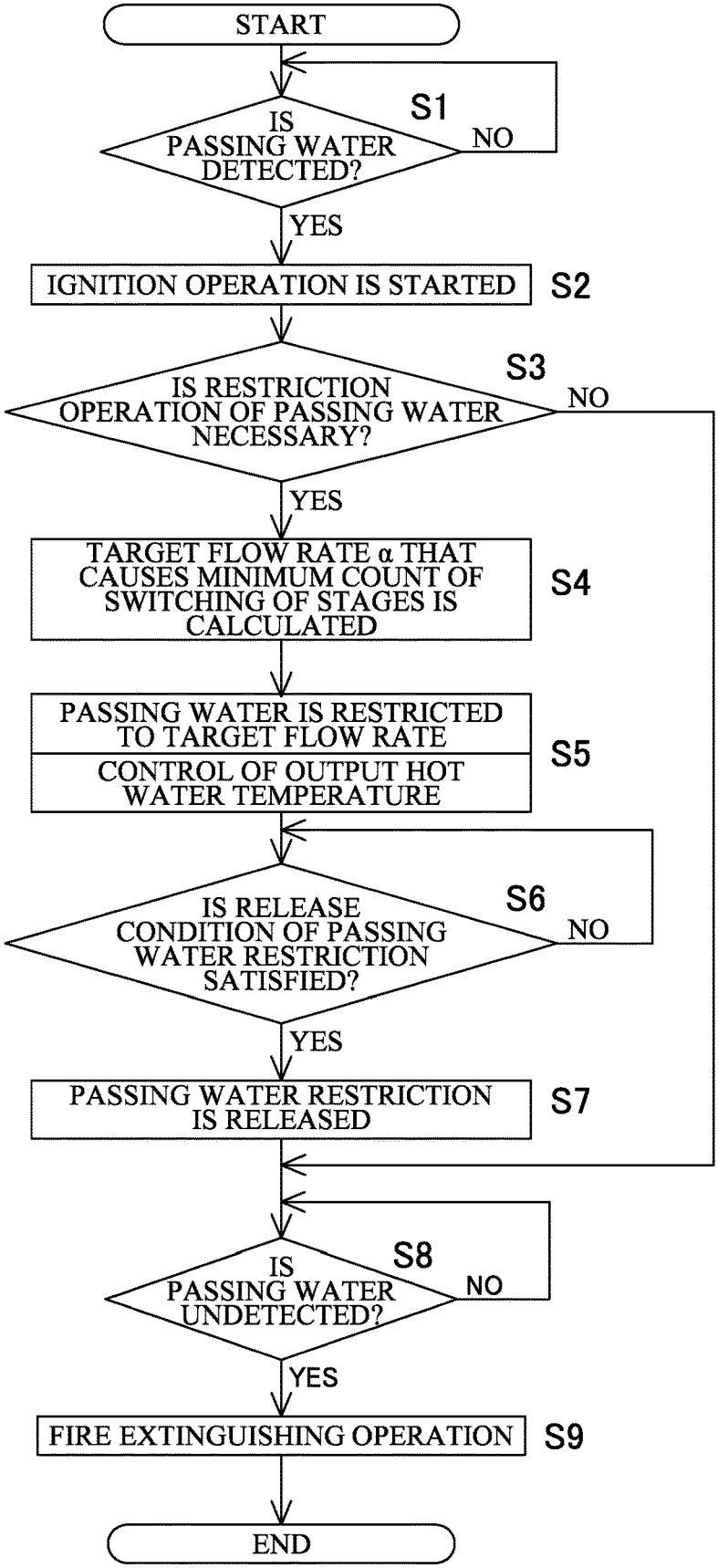
FIG. 2 is a flowchart of an operation control of the water heater.

An operation of the water heater 1 will be described based on a flowchart in FIG. 2.

First, the hot water tap 20 is opened to pass water within the apparatus. When the passing water is detected (a signal obtained from the water quantity sensor 17 confirms that the passing water quantity flowing inside the apparatus exceeds an ignition water quantity) at S1, the controller 12 starts an ignition operation at S2. That is, a pre-purge is performed by causing the air supply fan 3 to rotate. The main solenoid valve 9 and the switching solenoid valve 11, and the gas proportional valve 10 are each opened to supply gas to the burner 4 and the ignitor 13 is operated to perform an ignition control of the burner 4. The ignition of the burner 4 is confirmed with the flame rod 15.

Next, at S3, the controller 12 determines whether a restriction operation of the passing water is necessary or not. The restriction operation of the passing water is determined to be necessary when a preliminarily set start condition of the passing water restriction (here, in such case where a difference between an output hot water temperature obtained from the thermistor 21 as a temperature detection means and the set temperature set with the remote control exceeds, for example, 10° C.) is satisfied. On the other hand, when it is determined that the restriction operation of the passing water is not necessary here, the operation proceeds to S8.

When the restriction operation of the passing water is determined to be necessary at S3, a target flow rate α is calculated at S4. The target flow rate α is smaller than the predetermined water quantity and causes a minimum count of switching of the combustion stages of the burners 4. The target flow rate α is calculated based on a calculation formula preliminarily set by the maximum heat amount provided in the combustion stages of the burners 4 currently burning, a temperature of inflow water, and the set temperature.

When the target flow rate α is calculated, the controller 12 sets the water servo 18 to the calculated target flow rate α at S5. The controller 12 continuously changes a gas quantity by controlling a degree of opening of the gas proportional valve 10 in accordance with the difference between the output hot water temperature (detected temperature) detected with the thermistor 21 as the temperature detection means and the set temperature set with the remote control 23. Thus, the controller 12 performs an output hot water temperature control in order to cause the output hot water temperature to match the set temperature.

Then, at S6, it is determined whether a release condition of the passing water restriction is satisfied or not. Here, it is satisfied when the difference between the output hot water temperature and the set temperature is, for example, within ±3° C.

When the release condition of the passing water restriction is satisfied, the passing water restriction is released at S7 and a control to gradually return the water servo 18 back to the predetermined water quantity is performed.

When the passing water is no longer detected at S8 due to a closure of the hot water tap 20, the controller 12 closes each of the main solenoid valve 9, the switching solenoid valve 11, and the gas proportional valve 10 at S9 to extinguish the fire of the burner 4. The air supply fan 3 is caused to rotate for a certain period of time to execute a fire extinguishing operation in which a post-purge is performed.

Figure 3A:
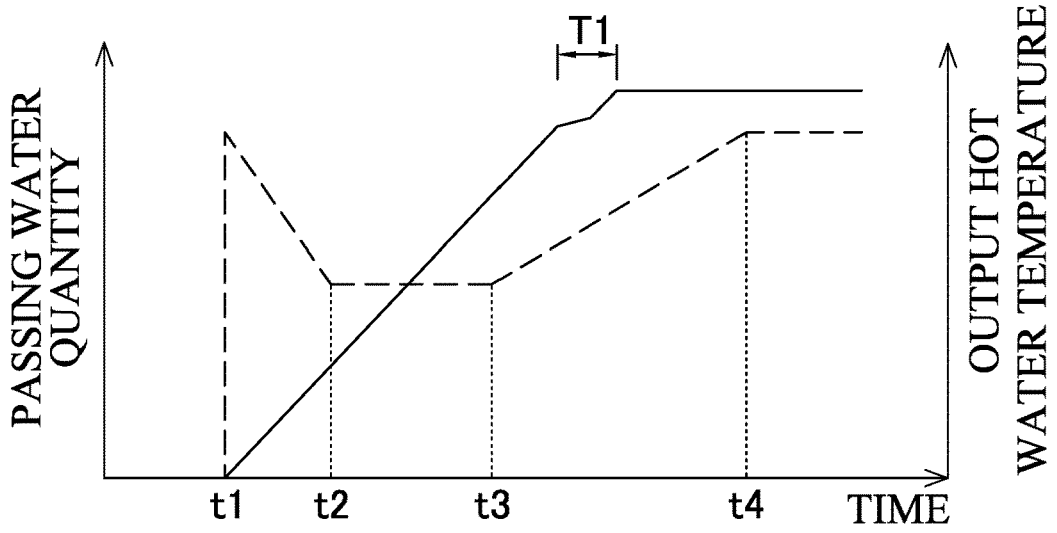
FIG. 3A is a graph showing a passing water control and change in output hot water temperature.
Figure 3B:
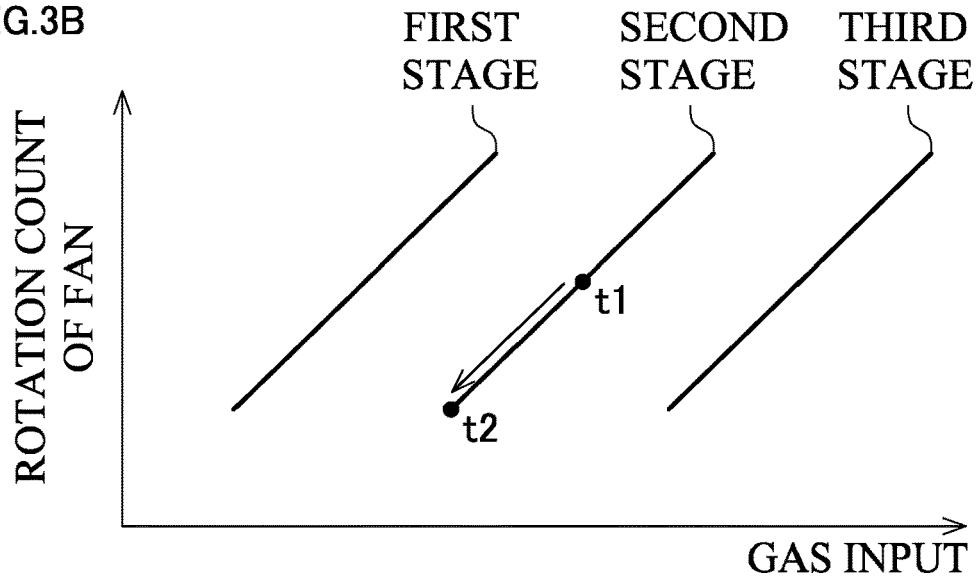
FIG. 3B is a graph showing a switching control of combustion stages of burners when passing water is restricted.
Figure 3C:
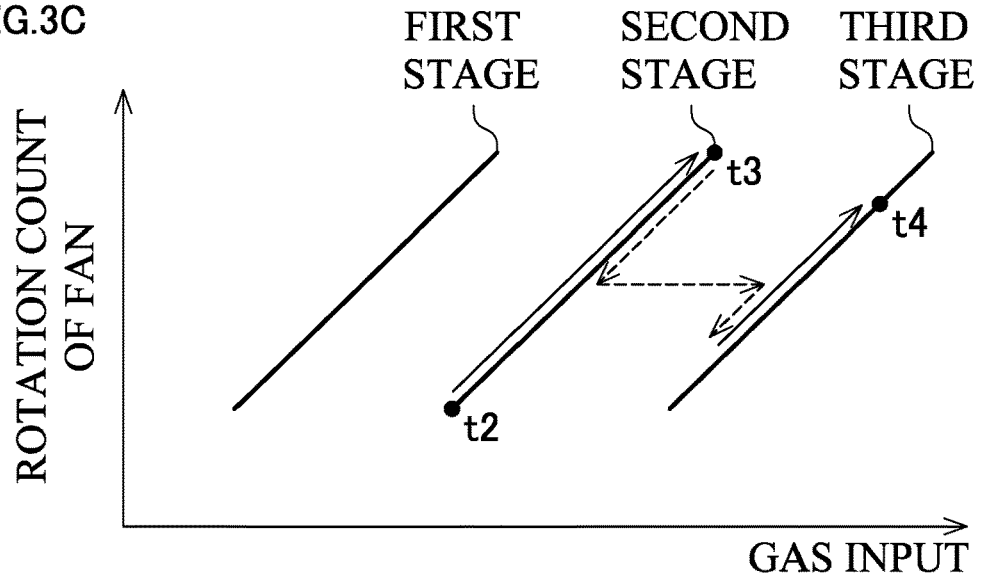
FIG. 3C is a graph showing a switching control of combustion stages of burners when the restriction of the passing water is released.
Figure 4:
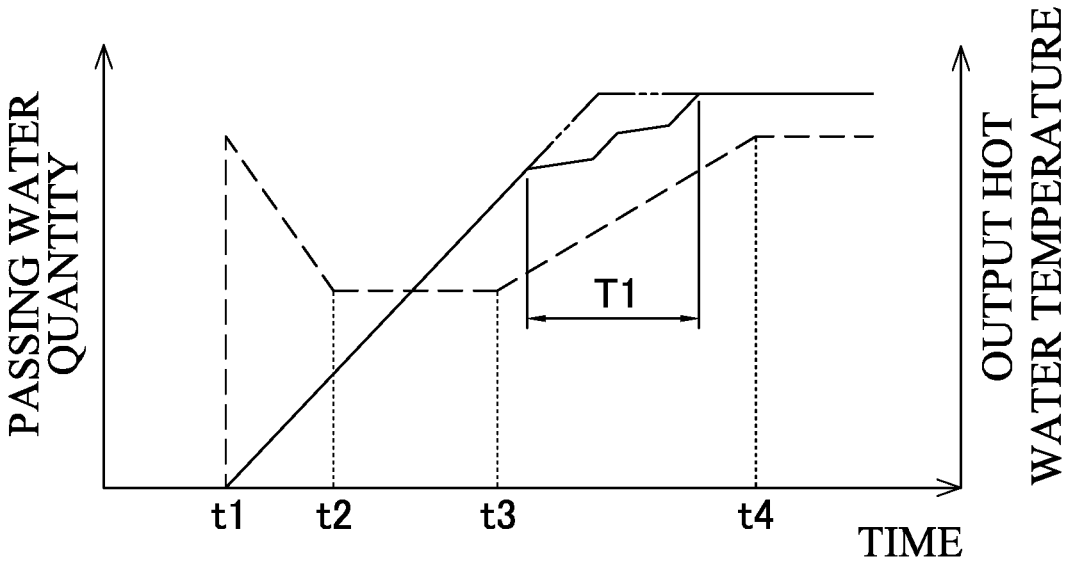
FIG.4 Prior Art
FIG. 4 is a graph showing a conventional passing water control and change in output hot water temperature.

FIG. 3A is, similarly to FIG. 4, a graph showing a restriction control of the passing water quantity at the start of the hot water supply and change in the output hot water temperature in the above-described configuration. FIGS. 3B and 3C are graphs showing a switching control of the combustion stages of the burners 4. FIG. 3B shows when the passing water is restricted and FIG. 3C shows when the passing water restriction is released.

As is apparent here, the passing water restriction at t2 is set to the target flow rate α. Accordingly, when the passing water is restricted, while the burner 4 is remained in the second stage, the control to cause the minimum value of the gas input is kept until t2 and switching of the combustion stages is not performed. When the passing water restriction is released between t3 and t4, switching of the combustion stages of the burners 4 is performed only once.

Figure 5A:
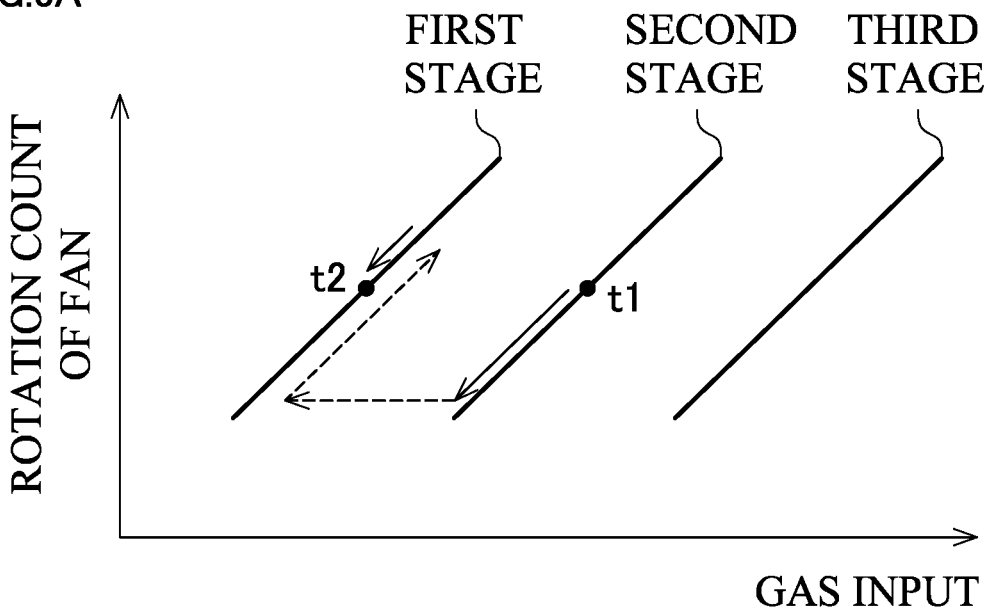
Prior Art FIG.5A
FIG. 5A is a graph showing a switching control of combustion stages of burners when passing water is restricted conventionally.
Figure 5B:
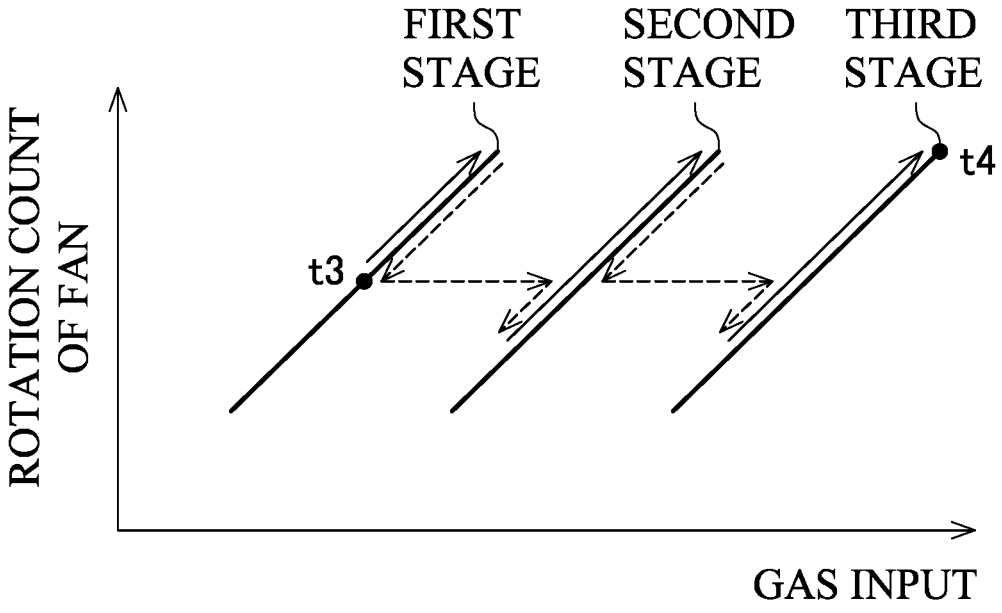
Prior Art FIG.5B
FIG. 5B is a graph showing a switching control of combustion stages of burners when the restriction of the passing water is released conventionally.

Accordingly, compared with a case where switching of the combustion stages is performed twice like FIG. 5B, a fluctuation of the output hot water temperature that is increasing is reduced (a portion T1 in FIG. 3A). It is seen that the output hot water temperature is approximately linearly changed with respect to FIG. 4 and an occurrence of the undershoot is inhibited.

Thus, according to the water heater 1 of the above-described configuration, the controller 12 performs a passing water quantity control by calculating the target flow rate α and setting the water servo 18 to the target flow rate α upon confirmation that the predetermined start condition of the passing water restriction is satisfied at the start of the hot water supply. The target flow rate α is smaller than the predetermined water quantity and causes the minimum count of switching of the combustion stages of the burners 4. The controller 12 executes the passing water control in which the passing water quantity is returned back to the predetermined water quantity by gradually releasing the passing water restriction upon confirmation that the predetermined release condition of the passing water restriction is satisfied. Thus, the undershoot can be inhibited when the restriction of the passing water quantity is released.

Here in particular, the start condition of the passing water restriction is that the output hot water temperature is lower than the set temperature by 10° C. or more by comparing the output hot water temperature with the set temperature. Therefore, even in the case of what is called the cold start, the reach time to the set temperature can be reduced, thereby leading to the conserved water and gas.

On the other hand, in the case of a hot start in which the detected temperature becomes high, the start condition of the passing water restriction is not satisfied. Therefore, the passing water restriction is not executed and prevention of damaging a convenience of a user can be ensured.

Furthermore, the release condition of the passing water restriction is that the difference between the output hot water temperature and the set temperature is within ±3° C. Therefore, the passing water quantity can be returned back to the predetermined water quantity at an appropriate timing.

In the above-described configuration, the target flow rate in which switching of the combustion stages of the burners is once (minimum count) is calculated. However, a target flow rate with which the count of switching of the combustion stages decreases may be calculated or a target flow rate with which no switching of the combustion stages occurs may be calculated.

The start condition of the passing water restriction is that the difference between the output hot water temperature and the set temperature exceeds 10° C. However, the difference can be set to a value other than 10° C. Also, the start condition of the passing water restriction is not limited to this condition but may be when five minutes or more passes after the last termination of the operation. Furthermore, the start condition of the passing water restriction may be determined to be necessary at a first operation after turning on the power or may be when a plurality of these conditions meet. Similarly, the release condition of the passing water restriction is not limited to the condition that the difference between the output hot water temperature and the set temperature is within ±3° C. but the difference can be changed as necessary and other conditions can also be set.

The configuration of the water heater itself is not limited to the above-described content. The disclosure is applicable to a water heater as long as the water heater includes the passing water quantity control means, such as the water servo. The water heater may include not only a water heater with more or less stages of the burners, but also, for example, a water heater of a type without a bypass pipe, a water heater of a type provided with a bath side circuit that is configured to fill hot water in a bath tub and reheat by including a heat exchanger for bath, and a water heater of a type provided with a heat exchanger for a latent heat recovery.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. A water heater comprising:

a plurality of stages of burners;

a water supply pipe;

a hot water outlet pipe;

a heat exchanger coupled to the water supply pipe and the hot water outlet pipe, the heat exchanger being heated with the burner;

a passing water quantity control unit disposed in the water supply pipe, the passing water quantity control unit controlling a passing water quantity in the heat exchanger;

a temperature detection unit that detects a hot water temperature inside the hot water outlet pipe; and an operation control unit that executes an output hot water temperature control in which a detected temperature obtained from the temperature detection unit is caused to match a set temperature by a switching control of combustion stages of the burners and an operational control of the passing water quantity control unit, wherein the operation control unit, upon confirmation that a predetermined start condition of a passing water restriction is satisfied at a start of a hot water supply, performs the output hot water temperature control by calculating a target flow rate that is smaller than a predetermined water quantity and causes one of no switching or a minimum count of switching of the combustion stages of the burners and, by configuring the passing water quantity control unit to have the target flow rate, and upon confirmation that a predetermined release condition of the passing water restriction is satisfied, executes the passing water control in which the passing water quantity is returned back to the predetermined water quantity by gradually releasing the passing water restriction.

2. The water heater according to claim 1, wherein the start condition of the passing water restriction is that the detected temperature is lower than the set temperature by at least a predetermined temperature by a comparison of the detected temperature with the set temperature.

3. The water heater according to claim 2, wherein the release condition of the passing water restriction is that a difference between the detected temperature and the set temperature is within a predetermined temperature range.

4. The water heater according to claim 1, wherein the release condition of the passing water restriction is that a difference between the detected temperature and the set temperature is within a predetermined temperature range.

* * * * *